US010978010B2

(12) United States Patent
Chang et al.

(10) Patent No.: US 10,978,010 B2
(45) Date of Patent: Apr. 13, 2021

(54) LOD TABLE ADJUSTMENT METHOD AND LOD TABLE ADJUSTMENT SYSTEM

(71) Applicant: TCL CHINA STAR OPTOELECTRONICS TECHNOLOGY CO., LTD., Guangdong (CN)

(72) Inventors: Bobiao Chang, Guangdong (CN); Yichien Wen, Guangdong (CN)

(73) Assignee: TCL China Star Optoelectronics Technolog Co., Ltd., Guangdong (CN)

( * ) Notice: Subject to any disclaimer, the term of this patent is extended or adjusted under 35 U.S.C. 154(b) by 0 days.

(21) Appl. No.: 16/616,976

(22) PCT Filed: Aug. 9, 2019

(86) PCT No.: PCT/CN2019/100000

§ 371 (c)(1),
(2) Date: Nov. 26, 2019

(65) Prior Publication Data

US 2021/0035513 A1 Feb. 4, 2021

(30) Foreign Application Priority Data

Jul. 30, 2019 (CN) ..... 2019 1 0697360

(51) Int. Cl.
*G09G 3/36* (2006.01)

(52) U.S. Cl.
CPC ..... *G09G 3/3607* (2013.01); *G09G 3/3648* (2013.01); *G09G 2310/0264* (2013.01); *G09G 2320/0233* (2013.01); *G09G 2320/0276* (2013.01); *G09G 2320/0626* (2013.01); *G09G 2320/0673* (2013.01)

(58) Field of Classification Search
CPC ..... G09G 3/3607; G09G 3/3648; G09G 2310/0264; G09G 2320/0276; G09G 2320/0673; G09G 2320/0626; G09G 2320/0233
See application file for complete search history.

(56) References Cited

U.S. PATENT DOCUMENTS

| | | | | |
|---|---|---|---|---|
| 2005/0104837 | A1* | 5/2005 | Baik | G09G 3/3611 345/99 |
| 2013/0002620 | A1* | 1/2013 | Du | G09G 3/3614 345/204 |
| 2016/0049113 | A1* | 2/2016 | Park | G09G 3/3266 345/212 |
| 2018/0082627 | A1* | 3/2018 | Deng | G09G 3/3275 |

* cited by examiner

*Primary Examiner* — Brent D Castiaux
(74) *Attorney, Agent, or Firm* — Mark M. Friedman

(57) ABSTRACT

The present invention provides a line over driving (LOD) table adjustment method and a system thereof, which divides a display panel into M*N blocks. In an i-th row and a j-th column in the LOD table corresponding to a block, according to a brightness value of a grayscale value of a pixel of a previous line and a current line corresponding to an initial grayscale value of over driving pixels, calculate a target brightness value of an adjustment screen corresponding to a combination of the grayscale value of the pixel of the previous line and the current line corresponding to the initial grayscale value of over driving pixels, and obtain a measured brightness value of the adjustment screen to compare whether the difference between the target brightness value and the measured brightness value is within the default error range value to determine a final grayscale value of over driving pixel.

16 Claims, 2 Drawing Sheets

LOD TABLE ADJUSTMENT METHOD AND LOD TABLE ADJUSTMENT SYSTEM

FIELD OF INVENTION

The present invention is related to the field of display technology, and specifically to a line over driving (LOD) table adjustment method and an LOD table adjustment system.

BACKGROUND OF INVENTION

Thin-film transistors (TFTs) are main driving elements in current liquid crystal display (LCD) devices and active-matrix organic light-emitting diode (AMOLED) display devices, and directly relate to display performance of flat panel display devices.

Most of the LCD devices in current market are backlight type LCD devices having an LCD panel and a backlight module. The working principle of the LCD panel is to apply a pixel voltage and a common voltage on a TFT array substrate and a color filter (CF) substrate, control rotation direction of liquid crystal molecules between these two substrates by an electric field formed by the pixel voltage and the common voltage, and let light of the backlight module transmit to produce images. A forming process of the LCD panel generally includes: an array process of front-end-of-line (such as thin-film, photolithography, etching, and stripping), a cell process of middle-of-line (such as laminating a TFT substrate to a CF substrate), and module assembly process of back-end-of-line (such as bonding a driving integrated circuit (IC) to a printed circuit board). The array process of front-end-of-line mainly forms the TFT substrate for controlling motion of the liquid crystal molecules. The cell process of middle-of-line mainly fills liquid crystal between the TFT substrate and the CF substrate. The module assembly process of back-end-of-line mainly integrates the driving IC and the printed circuit board for driving the liquid crystal molecules to rotate and displaying the images.

The LCD panel in the prior art usually adopts a pixel driving circuit having a flip-pixel structure. The pixel driving circuit includes a plurality of sub-pixels arranged in an array and a plurality of data lines extending in a vertical direction, and the plurality of sub-pixels in a column interleaved connect to its left and right neighboring the plurality of data lines.

Due to a characteristic of a longer response time of the liquid crystal and a shorter charging time of high resolution and high refresh frequency LCD panels, a charging of a solid color image (e.g. a grayscale value of all red sub-pixels and blue sub-pixels is 0, and a grayscale value of all green sub-pixels is 210) and a charging of a pure grayscale image (e.g. a grayscale value of all red sub-pixels, blue sub-pixels, and green sub-pixels is 210) have a significant difference. The charging of a solid color image often cannot achieve an expected effect, which seriously affects actual display quality of the image. Therefore, it is particularly important to improve the difference caused by a panel structure by over driving neighboring lines of sub-pixels through a line over driving (LOD) table.

SUMMARY OF INVENTION

A purpose of the present invention is to provide a line over driving (LOD) table adjustment method that can improve a pixel charging rate and increase a display quality of a display panel.

The purpose of the present invention is also to provide an LOD table adjustment system that can improve the pixel charging rate and increase the display quality of the display panel.

In order to realize the above purposes, the present invention provides an LOD table adjustment method, including the following steps:

step S1, dividing a display panel into M*N blocks, the M and the N being positive integers, respectively obtaining an LOD table corresponding to each of the blocks, the LOD table including a plurality of initial grayscale values of over driving pixels arranged in an array, and each of the plurality of initial grayscale values of over driving pixels corresponding to a combination of a grayscale value of a pixel of a previous line and a grayscale value of a pixel of a current line;

step S2, obtaining a gamma correction value of the display panel, and according to the gamma correction value, calculating a brightness value of the grayscale value of the pixel of the previous line and the grayscale value of the pixel of the current line corresponding to each of the plurality of initial grayscale values of over driving pixels in the LOD table corresponding to each of the blocks;

step S3, according to one of the plurality of initial grayscale values of over driving pixels in an i-th row and a j-th column corresponding to the brightness value of the grayscale value of the pixel of the previous line and the grayscale value of the pixel of the current line, calculating a target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and the i and the j being positive integers;

step S4, obtaining a measured brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column;

step S5, comparing whether a difference between the target brightness value and the measured brightness value is within a default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixel in the i-th row and the j-th column, and if the difference between the target brightness value and the measured brightness value is greater than the default error range value, proceeding to a step S6; and step S6, adding a grayscale value of one to the grayscale value of the pixel of the current line, and proceeding to the steps S4 and S5.

The LOD table adjustment method further includes the steps of:

step S7, repeating the steps S3 to S6 until all the final grayscale values of over driving pixel in the LOD table corresponding to each of the blocks are determined; and step S8, repeating the steps S2 to S7 until all the final grayscale values of over driving pixel in the LOD table corresponding to all the blocks are determined.

The M and the N are three.

In the step S1, the LOD table includes 256 of the plurality of initial grayscale values of over driving pixels arranged in an array.

In the step S2, a formula for calculating the brightness value of the grayscale value of the pixel of the previous line corresponding to each of the plurality of initial grayscale values of over driving pixels is:

$$Lv(u) = \left(\frac{u}{255}\right)^G * (b - a);$$

and a formula for calculating the brightness value of the grayscale value of the pixel of the current line corresponding to each of the plurality of initial grayscale values of over driving pixels is:

$$Lv(p) = \left(\frac{p}{255}\right)^G * (b - a);$$

wherein Lv(u) is the brightness value of the grayscale value of the pixel of the previous line, u is the grayscale value of the pixel of the previous line, Lv(p) is the brightness value of the grayscale value of the pixel of the current line, p is the grayscale value of the pixel of the current line, G is the gamma correction value, b is a brightness value of the pixel grayscale value of 255, and a is a brightness value of the pixel grayscale value of zero.

The gamma correction value is 2.2.

In the step S3, a formula for calculating the target brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column is:

$$y = \frac{Lv(u) + Lv(p)}{2};$$

wherein y is the target brightness value of the adjustment screen.

In the step S3 and the step S4, the adjustment screen alternately displays a plurality of lines of the grayscale value of the pixel of the previous line and the grayscale value of the pixel of the current line.

A number of pixel lines of the adjustment screen is equal to a number of pixel lines in resolution of the display panel.

The present invention further provides a line over driving (LOD) table adjustment system, including a display panel and an adjustment module connecting to the display panel. The adjustment module using the LOD table adjustment method described above to adjust the LOD table of the display panel.

A line over driving (LOD) table adjustment method of the present invention divides a display panel into M*N blocks, according to a gamma correction value to calculate a brightness value of a grayscale value of a pixel of a previous line and a grayscale value of a pixel of a current line corresponding to each of a plurality of initial grayscale values of over driving pixels in the LOD table corresponding to each of the blocks, according to one of the plurality of initial grayscale values of over driving pixels in an i-th row and a j-th column corresponding to the brightness value of the grayscale value of the pixel of the previous line and the grayscale value of the pixel of the current line to calculate a target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and obtain a measured brightness value of the adjustment screen. Comparing whether a difference between the target brightness value and the measured brightness value is within a default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixel in the i-th row and the j-th column, and if the difference between the target brightness value and the measured brightness value is greater than the default error range value, adding a grayscale value of one to the grayscale value of the pixel of the current line, and repeat the above steps until the difference between the target brightness value and the measured brightness value is less than or equal to the default error range value, which can determine a final grayscale value of over driving pixel in the i-th row and the j-th column. Repeat the above steps until all the final grayscale values of over driving pixel in the LOD table corresponding to each of the blocks are determined, and repeat the above steps until all the final grayscale values of over driving pixel in the LOD table corresponding to all the blocks are determined. The display panel is driven according to the final grayscale values of over driving pixel in the LOD table corresponding to all the blocks, which can improve a pixel charging rate and increase a display quality of a display panel. An LOD table adjustment system of the present invention can improve the pixel charging rate and increase the display quality of the display panel.

DESCRIPTION OF DRAWINGS

In order to further understand features and technical details of the present invention, please refer the following detailed description and drawings of the present invention. However, the drawings are only for reference and explanation, and are not intended to limit the present invention.

DETAILED DESCRIPTION

In order to further expound technical solutions adopted and advantages in the present invention, a detailed description is given to a preferred embodiment of the present invention and the attached drawings.

Figure 1:
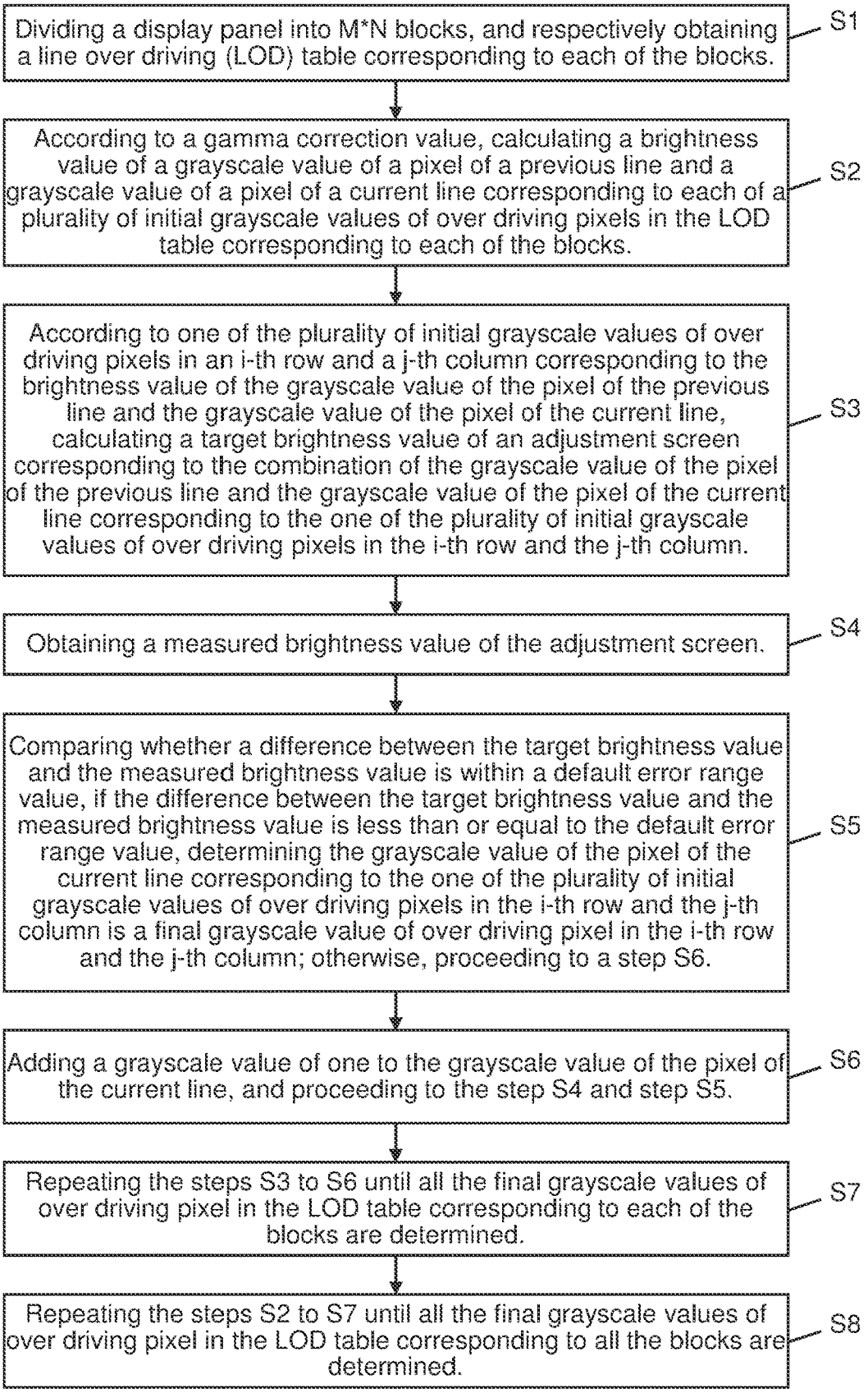
FIG. 1 is a flowchart of a line over driving (LOD) table adjustment method of the present invention.

Please refer to FIG. 1, the present invention provides a line over driving (LOD) table adjustment method, including the following steps:

step S1, dividing a display panel into M*N blocks, the M and the N being positive integers, respectively obtaining an LOD table corresponding to each of the blocks, the LOD table including a plurality of initial grayscale values of over driving pixels arranged in an array, and each of the plurality of initial grayscale values of over driving pixels corresponding to a combination of a grayscale value of a pixel of a previous line and a grayscale value of a pixel of a current line;

step S2, obtaining a gamma correction value of the display panel, and according to the gamma correction value, calculating a brightness value of the grayscale value of the pixel of the previous line and the grayscale value of the pixel of the current line corresponding to each of the plurality of initial grayscale values of over driving pixels in the LOD table corresponding to each of the blocks;

step S3, according to one of the plurality of initial grayscale values of over driving pixels in an i-th row and a j-th column corresponding to the brightness value of the grayscale value of the pixel of the previous line and the grayscale value of the pixel of the current line, calculating a target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and the i and the j being positive integers;

step S4, obtaining a measured brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column;

step S5, comparing whether a difference between the target brightness value and the measured brightness value is within a default error range value; if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixel in the i-th row and the j-th column, and if the difference between the target brightness value and the measured brightness value is greater than the default error range value, proceeding to a step S6; and step S6, adding a grayscale value of one to the grayscale value of the pixel of the current line, and proceeding to the steps S4 and S5.

The LOD table adjustment method further includes the steps of:

step S7, repeating the steps S3 to S6 until all the final grayscale values of over driving pixel in the LOD table corresponding to each of the blocks are determined; and step S8, repeating the steps S2 to S7 until all the final grayscale values of over driving pixel in the LOD table corresponding to all the blocks are determined.

It should be noted that, the present invention divides the display panel into M*N blocks, according to the gamma correction value to calculate the brightness value of the grayscale value of the pixel of the previous line and the grayscale value of the pixel of the current line corresponding to each of the plurality of initial grayscale values of over driving pixels in the LOD table corresponding to each of the blocks, according to one of the plurality of initial grayscale values of over driving pixels in the i-th row and the j-th column corresponding to the brightness value of the grayscale value of the pixel of the previous line and the grayscale value of the pixel of the current line to calculate the target brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column, and obtain the measured brightness value of the adjustment screen. Comparing whether the difference between the target brightness value and the measured brightness value is within the default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is the final grayscale value of over driving pixel in the i-th row and the j-th column, and if the difference between the target brightness value and the measured brightness value is greater than the default error range value, adding the grayscale value of one to the grayscale value of the pixel of the current line, and repeat the above steps until the difference between the target brightness value and the measured brightness value is less than or equal to the default error range value, which can determine the final grayscale value of over driving pixel in the i-th row and the j-th column. Repeat the above steps until all the final grayscale values of over driving pixel in the LOD table corresponding to each of the blocks are determined, and repeat the above steps until all the final grayscale values of over driving pixel in the LOD table corresponding to all the blocks are determined. The display panel is driven according to the final grayscale values of over driving pixel in the LOD table corresponding to all the blocks, which can improve a pixel charging rate and increase a display quality of the display panel. The LOD Table adjustment system of the present invention can improve the pixel charging rate and increase the display quality of the display panel.

Specifically, in the step S1, the M and the N are arranged in an array.

Furthermore, the M and the N are three, which divides the display panel into three rows, three columns, and a total of nine blocks. Of course, the display panel can also be divided into five rows, five columns, and a total of 25 blocks, or nine rows, nine columns, and a total of 81 blocks. The more the blocks are divided, the more obvious the display quality of the display panel is increased, but the amount of calculation is also greater. Therefore, the M and the N of the present invention are preferably three.

Specifically, in the step S1, the LOD table is as shown in the following table:

| Z/H | 0 | 4 | 8 | 16 | 24 | 32 | 48 | 64 | 80 | 96 | 112 | 128 | 160 | 192 | 224 | 255 |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 |
| 4 | 4 | 4 | 4 | 4 | 4 | 4 | 4 | 4 | 4 | 4 | 4 | 4 | 4 | 4 | 4 | 4 |
| 8 | 8 | 8 | 8 | 8 | 8 | 8 | 8 | 8 | 8 | 8 | 8 | 8 | 8 | 8 | 8 | 8 |
| 16 | 18 | 17 | 17 | 16 | 16 | 16 | 16 | 16 | 16 | 16 | 16 | 16 | 16 | 16 | 16 | 16 |
| 24 | 24 | 24 | 24 | 24 | 24 | 24 | 24 | 24 | 24 | 24 | 24 | 24 | 24 | 24 | 24 | 24 |
| 32 | 32 | 32 | 32 | 32 | 32 | 32 | 32 | 32 | 32 | 32 | 32 | 32 | 32 | 32 | 32 | 32 |
| 48 | 48 | 48 | 48 | 48 | 48 | 48 | 48 | 48 | 48 | 48 | 48 | 48 | 48 | 48 | 48 | 48 |

-continued

| Z/H | 0 | 4 | 8 | 16 | 24 | 32 | 48 | 64 | 80 | 96 | 112 | 128 | 160 | 192 | 224 | 255 |
|---|---|---|---|---|---|---|---|---|---|---|---|---|---|---|---|---|
| 64 | 64 | 64 | 64 | 64 | 64 | 64 | 64 | 64 | 64 | 64 | 64 | 64 | 64 | 64 | 64 | 64 |
| 80 | 81 | 80 | 80 | 80 | 80 | 80 | 80 | 80 | 80 | 80 | 80 | 80 | 80 | 80 | 80 | 80 |
| 96 | 97 | 96 | 96 | 96 | 96 | 96 | 96 | 96 | 96 | 96 | 96 | 96 | 96 | 96 | 96 | 96 |
| 112 | 113 | 112 | 112 | 112 | 112 | 112 | 112 | 112 | 112 | 112 | 112 | 112 | 112 | 112 | 112 | 112 |
| 128 | 129 | 129 | 128 | 128 | 128 | 128 | 128 | 128 | 128 | 128 | 128 | 128 | 128 | 128 | 128 | 128 |
| 160 | 164 | 161 | 160 | 160 | 160 | 160 | 160 | 160 | 160 | 160 | 160 | 160 | 160 | 159 | 160 | 160 |
| 192 | 195 | 193 | 192 | 192 | 192 | 192 | 192 | 192 | 192 | 192 | 192 | 192 | 192 | 192 | 192 | 192 |
| 224 | 226 | 224 | 224 | 224 | 224 | 224 | 224 | 224 | 224 | 224 | 224 | 224 | 224 | 224 | 224 | 224 |
| 255 | 255 | 255 | 255 | 255 | 255 | 255 | 255 | 255 | 255 | 255 | 255 | 255 | 255 | 255 | 255 | 255 |

The LOD table is a 16*16 LOD table, the LOD table includes 256 of the plurality of initial grayscale values of over driving pixels arranged in an array. Of course, it can be a 17*17 LOD table or a 33*33 LOD table, which is not limited herein. The horizontal axis H in the 16*16 LOD table is the grayscale value of the pixel of the previous line, and the vertical axis Z is the grayscale value of the pixel of the current line. For example, a initial grayscale value of over driving pixel in the $15^{th}$ row and second column is 224, and the initial grayscale value of over driving pixel in the $15^{th}$ row and second column corresponds to a combination of a grayscale value of a pixel of a previous line of four and a grayscale value of a pixel of a current line of 224.

Specifically, in the step S2, a formula for calculating the brightness value of the grayscale value of the pixel of the previous line corresponding to each of the plurality of initial grayscale values of over driving pixels is:

$$Lv(u) = \left(\frac{u}{255}\right)^G * (b - a);$$

and a formula for calculating the brightness value of the grayscale value of the pixel of the current line corresponding to each of the plurality of initial grayscale values of over driving pixels is:

$$Lv(p) = \left(\frac{p}{255}\right)^G * (b - a);$$

wherein Lv(u) is the brightness value of the grayscale value of the pixel of the previous line, u is the grayscale value of the pixel of the previous line, Lv(p) is the brightness value of the grayscale value of the pixel of the current line, p is the grayscale value of the pixel of the current line, G is the gamma correction value, b is a brightness value of the pixel grayscale value of 255, and a is a brightness value of the pixel grayscale value of zero. Brightness values of all the grayscale value of pixels in the horizontal axis H and the vertical axis Z in the LOD table, such as Lv(0), Lv(4), . . . , Lv(224), and Lv(255).

Furthermore, the gamma correction value is selected according to a characteristic of the display panel, and in the present invention is preferably 2.2.

Specifically, in the step S3, a formula for calculating the target brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column is:

$$y = \frac{Lv(u) + Lv(p)}{2};$$

wherein y is the target brightness value of the adjustment screen.

Specifically, in the step S3 and the step S4, the adjustment screen alternately displays a plurality of lines of the grayscale value of the pixel of the previous line and the grayscale value of the pixel of the current line. For example, an image uses a grayscale value of the pixel of the previous line to display odd line pixels, and uses a grayscale value of the pixel of the current line to display even line pixels.

Furthermore, a number of pixel lines of the adjustment screen is equal to a number of pixel lines in resolution of the display panel. For example, a display panel has a resolution of 1920×1200, and its number of pixel lines of the adjustment screen is 1200.

Specifically, the display panel is a pixel driving circuit having a flip-pixel structure. The pixel driving circuit includes a plurality of sub-pixels arranged in an array and a plurality of data lines extending in a vertical direction, and the plurality of sub-pixels in a column interleaved connect to its left and right neighboring the plurality of data lines.

Specifically, the present invention exemplifies an initial grayscale value of over driving pixel in the $15^{th}$ row and second column of the LOD table: the initial grayscale value of over driving pixel in the $15^{th}$ row and second column corresponds to a combination of a grayscale value of a pixel of a previous line of four and a grayscale value of a pixel of a current line of 224. According to a gamma correction value, calculate and obtain a brightness value Lv(4) of the grayscale value of the pixel of the previous line of four and a brightness value Lv(224) of the grayscale value of the pixel of the current line of 224. Then obtain a target brightness value $$y = \frac{Lv(4) + Lv(224)}{2}$$

of an adjustment screen corresponding to the initial grayscale value of over driving pixel in the $15^{th}$ row and second column. The adjustment screen alternately displays a plurality of lines of the grayscale value of the pixel of the previous line of four and the grayscale value of the pixel of the current line of 224. Obtain a measured brightness value of the adjustment screen of $x_1$, and comparing whether a difference between the target brightness value of y and the measured brightness value of $x_1$ is within a default error range value of z. If $y-x_1<=z$, the grayscale value of the pixel of the current line of 224 corresponding to the initial grayscale value of over driving pixels in the $15^{th}$ row and second column is a final grayscale value of over driving pixel in the $15^{th}$ row and second column. If $y-x_1>=z$, add a grayscale value of one to the grayscale value of the pixel of the current line of 224, and becomes 225. The adjustment screen alternately displays a plurality of lines of the grayscale value of the pixel of the previous line of four and the grayscale value of the pixel of the current line of 225. Obtain a measured brightness value of the adjustment screen of $x_2$, and comparing whether a difference between the target brightness value of y and the measured brightness value of $x_2$ is within the default error range value of z. If $y-x_2<=z$, it is determined that the grayscale value of the pixel of the current line of 225 after adding a grayscale value of one is a final grayscale value of over driving pixel in the $15^{th}$ row and second column. Otherwise, keep adding a grayscale value of one to the grayscale value of the pixel of the current line of 225 to become 226. Repeat the above steps until the difference between the target brightness value and the measured brightness value is less than or equal to the default error range value, which can determine a final grayscale value of over driving pixel in the i-th row and the j-th column. Repeat the above steps until all the final grayscale values of over driving pixel in the LOD table corresponding to each of the blocks are determined, and repeat the above steps until all the final grayscale values of over driving pixel in the LOD table corresponding to all the blocks are determined.

Figure 2:
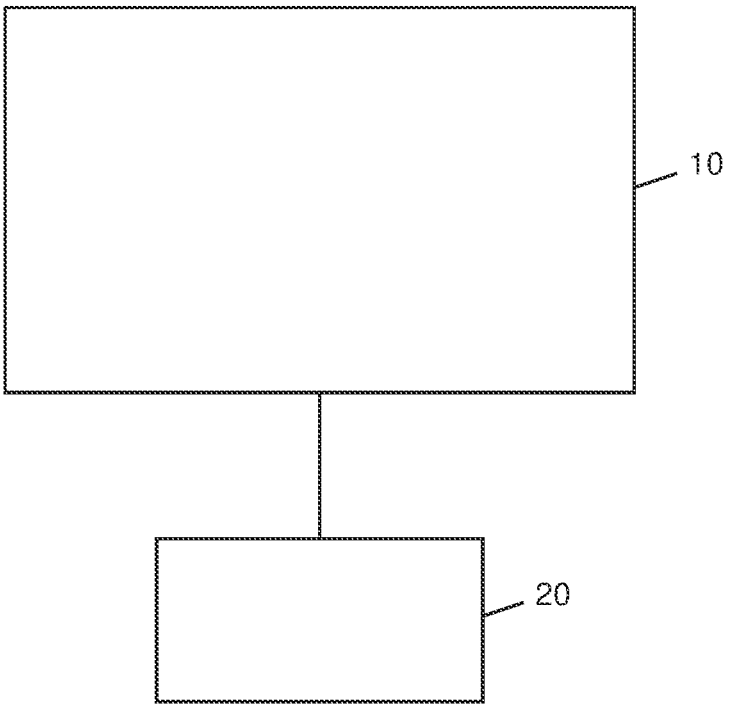
FIG. 2 is a schematic diagram of an LOD table adjustment system of the present invention.

Please refer to FIG. 2, which is based on the above LOD table adjustment method, the present invention further provides an LOD table adjustment system, including a display panel 10 and an adjustment module 20 connecting to the display panel 10. The adjustment module 20 uses the LOD table adjustment method described above to adjust the LOD table of the display panel.

To summarize, the present invention divides a display panel into M*N blocks, according to a gamma correction value to calculate a brightness value of a grayscale value of a pixel of a previous line and a grayscale value of a pixel of a current line corresponding to each of a plurality of initial grayscale values of over driving pixels in a line over driving (LOD) table corresponding to each of the blocks, according to one of the plurality of initial grayscale values of over driving pixels in an i-th row and a j-th column corresponding to the brightness value of the grayscale value of the pixel of the previous line and the grayscale value of the pixel of the current line to calculate the target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and obtain the measured brightness value of the adjustment screen. Comparing whether a difference between the target brightness value and the measured brightness value is within the default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixel in the i-th row and the j-th column, and if the difference between the target brightness value and the measured brightness value is greater than the default error range value, adding the grayscale value of one to the grayscale value of the pixel of the current line, and repeat the above steps until the difference between the target brightness value and the measured brightness value is less than or equal to the default error range value, which can determine the final grayscale value of over driving pixel in the i-th row and the j-th column. Repeat the above steps until all the final grayscale values of over driving pixel in the LOD table corresponding to each of the blocks are determined, and repeat the above steps until all the final grayscale values of over driving pixel in the LOD table corresponding to all the blocks are determined. The display panel is driven according to the final grayscale values of over driving pixel in the LOD table corresponding to all the blocks, which can improve a pixel charging rate and increase a display quality of the display panel. The LOD table adjustment system of the present invention can improve the pixel charging rate and increase the display quality of the display panel.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A line over driving (LOD) table adjustment method, comprising the following steps:

step S1, dividing a display panel into M*N blocks, the M and the N being positive integers, respectively obtaining an LOD table corresponding to each of the blocks, the LOD table comprising a plurality of initial grayscale values of over driving pixels arranged in an array, and each of the plurality of initial grayscale values of over driving pixels corresponding to a combination of a grayscale value of a pixel of a previous line and a grayscale value of a pixel of a current line;

step S2, obtaining a gamma correction value of the display panel, and according to the gamma correction value, calculating a brightness value of the grayscale value of the pixel of the previous line and the grayscale value of the pixel of the current line corresponding to each of the plurality of initial grayscale values of over driving pixels in the LOD table corresponding to each of the blocks;

step S3, according to one of the plurality of initial grayscale values of over driving pixels in an i-th row and a j-th column corresponding to the brightness value of the grayscale value of the pixel of the previous line and the grayscale value of the pixel of the current line, calculating a target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and the i and the j being positive integers;

step S4, obtaining a measured brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column;

step S5, comparing whether a difference between the target brightness value and the measured brightness value is within a default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixels in the i-th row and the j-th column, and if the difference between the target brightness value and the measured brightness value is greater than the default error range value, proceeding to a step S6;

step S6, adding a grayscale value of one to the grayscale value of the pixel of the current line, and proceeding to the steps S4 and S5;

step S7, repeating the steps S3 to S6 until all the final grayscale values of over driving pixels in the LOD table corresponding to each of the blocks are determined; and step S8, repeating the steps S2 to S7 until all the final grayscale values of over driving pixels in the LOD table corresponding to all the blocks are determined.

2. The LOD table adjustment method as claimed in claim 1, wherein the M and the N are three.

3. The LOD table adjustment method as claimed in claim 1, wherein in the step S1, the LOD table comprises 256 of the plurality of initial grayscale values of over driving pixels arranged in an array.

4. The LOD table adjustment method as claimed in claim 1, wherein in the step S2, a formula for calculating the brightness value of the grayscale value of the pixel of the previous line corresponding to each of the plurality of initial grayscale values of over driving pixels is:

$$Lv(u) = \left(\frac{u}{255}\right)^G * (b - a);$$

and a formula for calculating the brightness value of the grayscale value of the pixel of the current line corresponding to each of the plurality of initial grayscale values of over driving pixels is:

$$Lv(p) = \left(\frac{p}{255}\right)^G * (b - a);$$

wherein Lv(u) is the brightness value of the grayscale value of the pixel of the previous line, u is the grayscale value of the pixel of the previous line, Lv(p) is the brightness value of the grayscale value of the pixel of the current line, p is the grayscale value of the pixel of the current line, G is the gamma correction value, b is a brightness value of the pixel grayscale value of 255, and a is a brightness value of the pixel grayscale value of zero.

5. The LOD table adjustment method as claimed in claim 4, wherein the gamma correction value is 2.2.

6. The LOD table adjustment method as claimed in claim 4, wherein in the step S3, a formula for calculating the target brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column is:

$$y = \frac{Lv(u) + Lv(p)}{2};$$

wherein y is the target brightness value of the adjustment screen.

7. The LOD table adjustment method as claimed in claim 1, wherein in the step S3 and the step S4, the adjustment screen alternately displays a plurality of lines of the grayscale value of the pixel of the previous line and the grayscale value of the pixel of the current line.

8. The LOD table adjustment method as claimed in claim 7, wherein a number of pixel lines of the adjustment screen is equal to a number of pixel lines in resolution of the display panel.

9. A line over driving (LOD) table adjustment system, comprising:

a display panel; and an adjustment module connecting to the display panel, the adjustment module using an LOD table adjustment method to adjust an LOD table of the display panel;

wherein the LOD table adjustment method comprises the steps of:

step S1, dividing a display panel into M*N blocks, the M and the N being positive integers, respectively obtaining an LOD table corresponding to each of the blocks, the LOD table comprising a plurality of initial grayscale values of over driving pixels arranged in an array, and each of the plurality of initial grayscale values of over driving pixels corresponding to a combination of a grayscale value of a pixel of a previous line and a grayscale value of a pixel of a current line;

step S2, obtaining a gamma correction value of the display panel, and according to the gamma correction value, calculating a brightness value of the grayscale value of the pixel of the previous line and the grayscale value of the pixel of the current line corresponding to each of the plurality of initial grayscale values of over driving pixels in the LOD table corresponding to each of the blocks;

step S3, according to one of the plurality of initial grayscale values of over driving pixels in an i-th row and a j-th column corresponding to the brightness value of the grayscale value of the pixel of the previous line and the grayscale value of the pixel of the current line, calculating a target brightness value of an adjustment screen corresponding to the combination of the grayscale value of the pixel of the previous line and the grayscale value of the pixel of the current line corresponding to the one of the plurality of initial grayscale values of over driving pixels in the i-th row and the j-th column, and the i and the j being positive integers;

step S4, obtaining a measured brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column;

step S5, comparing whether a difference between the target brightness value and the measured brightness value is within a default error range value, if the difference between the target brightness value and the measured brightness value is less than or equal to the default error range value, the grayscale value of the pixel of the current line corresponding to the one of the plurality of initial grayscale values of over driving pixels in the i-th row and the j-th column is a final grayscale value of over driving pixels in the i-th row and the j-th column, and if the difference between the target brightness value and the measured brightness value is greater than the default error range value, proceeding to a step S6;

step S6, adding a grayscale value of one to the grayscale value of the pixel of the current line, and proceeding to the steps S4 and S5;

step S7, repeating the steps S3 to S6 until all the final grayscale values of over driving pixels in the LOD table corresponding to each of the blocks are determined; and step S8, repeating the steps S2 to S7 until all the final grayscale values of over driving pixels in the LOD table corresponding to all the blocks are determined.

10. The LOD table adjustment system as claimed in claim 9, wherein the M and the N are three.

11. The LOD table adjustment system as claimed in claim 9, wherein in the step S1, the LOD table comprises 256 of the plurality of initial grayscale values of over driving pixels arranged in an array.

12. The LOD table adjustment system as claimed in claim 9, wherein in the step S2, a formula for calculating the brightness value of the grayscale value of the pixel of the previous line corresponding to each of the plurality of initial grayscale values of over driving pixels is:

$$Lv(u) = \left(\frac{u}{255}\right)^G * (b - a);$$

and a formula for calculating the brightness value of the grayscale value of the pixel of the current line corresponding to each of the plurality of initial grayscale values of over driving pixels is:

$$Lv(p) = \left(\frac{p}{255}\right)^G * (b - a);$$

wherein Lv(u) is the brightness value of the grayscale value of the pixel of the previous line, u is the grayscale value of the pixel of the previous line, Lv(p) is the brightness value of the grayscale value of the pixel of the current line, p is the grayscale value of the pixel of the current line, G is the gamma correction value, b is a brightness value of the pixel grayscale value of 255, and a is a brightness value of the pixel grayscale value of zero.

13. The LOD table adjustment system as claimed in claim 12, wherein the gamma correction value is 2.2.

14. The LOD table adjustment system as claimed in claim 12, wherein in the step S3, a formula for calculating the target brightness value of the adjustment screen corresponding to the combination of the grayscale value of the pixel of the previous line and the grayscale value of the pixel of the current line corresponding to the one of the plurality of initial grayscale values of over driving pixels in the i-th row and the j-th column is:

$$y = \frac{Lv(u) + Lv(p)}{2};$$

wherein y is the target brightness value of the adjustment screen.

15. The LOD table adjustment system as claimed in claim 9, wherein in the step S3 and the step S4, the adjustment screen alternately displays a plurality of lines of the grayscale value of the pixel of the previous line and the grayscale value of the pixel of the current line.

16. The LOD table adjustment system as claimed in claim 15, wherein a number of pixel lines of the adjustment screen is equal to a number of pixel lines in resolution of the display panel.

* * * * *